United States Patent [19]

deNora et al.

[11] Patent Number: 4,789,443

[45] Date of Patent: Dec. 6, 1988

[54] NOVEL ELECTROLYSIS CELL

[75] Inventors: Oronzio deNora, Milan, Italy; Placido M. Spaziante, Lugano, Switzerland

[73] Assignee: Oronzio deNora Impianti Elettrochimici S.p.A., Milan, Italy

[21] Appl. No.: 933,037

[22] Filed: Nov. 20, 1986

Related U.S. Application Data

[60] Continuation of Ser. No. 382,670, May 27, 1982, abandoned, which is a division of Ser. No. 151,695, May 20, 1980, Pat. No. 4,341,604, which is a continuation-in-part of Ser. No. 57,255, Jul. 12, 1979, Pat. No. 4,343,689.

[30] Foreign Application Priority Data

Jul. 27, 1978 [IT] Italy ..... 26171 A/78

[51] Int. Cl.[4] ..... C25B 1/00

[52] U.S. Cl. ..... 204/98; 204/128; 204/252; 204/253; 204/254; 204/255

[58] Field of Search ..... 204/98, 128, 252–256, 204/263–266

[56] References Cited

U.S. PATENT DOCUMENTS

| | | | |
|---|---|---|---|
| 1,152,772 | 9/1915 | Wheeler | 204/283 |
| 3,017,338 | 3/1958 | Butler, Jr. et al. | 204/98 |
| 3,102,085 | 6/1959 | Edwards et al. | 204/130 |
| 3,242,059 | 7/1961 | Cottam et al. | 204/128 |
| 3,344,053 | 5/1964 | Neipert et al. | 204/283 |
| 3,446,725 | 3/1966 | Spengler et al. | 204/242 |
| 3,475,302 | 8/1967 | Langer et al. | 204/129 |
| 3,674,676 | 7/1972 | Fogelman | 204/286 |
| 3,871,988 | 3/1975 | Harke et al. | 204/266 |
| 3,873,437 | 3/1975 | Pulver | 204/98 |
| 3,910,827 | 10/1975 | Raetzsch et al. | 204/98 |
| 3,928,166 | 12/1975 | O'Leary et al. | 204/252 |
| 3,932,197 | 1/1976 | Katz et al. | 204/180 |
| 3,968,273 | 7/1976 | Kastening et al. | 204/84 |
| 3,981,790 | 9/1976 | Olsen et al. | 204/286 |
| 3,989,615 | 11/1976 | Kiga et al. | 204/252 |
| 4,017,376 | 4/1977 | Mose et al. | 204/288 |
| 4,024,036 | 5/1977 | Nakamura et al. | 204/129 |
| 4,026,785 | 5/1977 | Ford | 204/286 |
| 4,033,849 | 7/1977 | Pohto et al. | 204/288 |
| 4,056,452 | 11/1977 | Campbell | 204/266 |
| 4,057,479 | 11/1977 | Campbell | 204/258 |
| 4,096,054 | 6/1978 | Specht et al. | 204/263 |
| 4,101,410 | 7/1978 | Kircher et al. | 204/282 |
| 4,105,514 | 8/1978 | Justice et al. | 204/128 |
| 4,124,477 | 11/1978 | Tokawa et al. | 204/252 |
| 4,146,457 | 3/1979 | Couper et al. | 204/252 |
| 4,154,665 | 5/1979 | Boulton | 204/253 |
| 4,177,116 | 12/1979 | deNora et al. | 204/98 |
| 4,191,618 | 3/1980 | Coker et al. | 204/98 |
| 4,247,376 | 1/1981 | Dempsey et al. | 204/128 |
| 4,268,365 | 5/1981 | Iijima et al. | 204/98 |
| 4,340,452 | 7/1982 | deNora et al. | 204/129 |
| 4,341,604 | 7/1982 | deNora et al. | 204/98 |
| 4,343,689 | 8/1982 | deNora et al. | 204/253 |
| 4,343,690 | 8/1982 | deNora | 204/263 |
| 4,444,632 | 4/1984 | deNora | 204/98 |
| 4,468,311 | 8/1984 | deNora et al. | 204/252 |
| 4,530,743 | 7/1985 | deNora | 204/98 |
| 4,536,263 | 8/1985 | deNora et al. | 204/98 |
| 4,592,822 | 6/1986 | deNora | 204/252 |
| 4,663,003 | 5/1987 | deNora et al. | 204/128 |

FOREIGN PATENT DOCUMENTS

| | | |
|---|---|---|
| 52-75666 | 6/1977 | Japan . |
| 1268182 | 3/1972 | United Kingdom . |
| 1480538 | 7/1977 | United Kingdom . |
| 1490650 | 11/1977 | United Kingdom . |
| 2009792 | 7/1978 | United Kingdom . |
| 2007260A | 5/1979 | United Kingdom . |
| 2011950 | 7/1979 | United Kingdom . |

*Primary Examiner*—John F. Niebling
*Assistant Examiner*—Kathryn Gorgos
*Attorney, Agent, or Firm*—Bierman & Muserlian

[57] ABSTRACT

An electrolysis cell comprising a housing containing a plurality of alternating anode units and cathode units and an ion permeable membrane sheet disposed therebetween and having in direct contact with the opposite sides of the membrane sheet a porous anode and a porous cathode, said cathode units comprising a pair of spaced foraminous cathodes of the same polarity forming a space for catholyte therebetween and means for flowing aqueous electrolyte through the catholyte space of the cathode unit and means for removing electrolysis products, the anode units comprising a pair of spaced foraminous anodes forming a space for anolyte therebetween, means for flowing aqueous halide solution through the said anolyte space and means for removing electrolysis products therefrom and means for uniformly compressing the units and membranes together and to a novel method of generating halogens by electrolysis of aqueous halide solutions.

20 Claims, 8 Drawing Sheets

NOVEL ELECTROLYSIS CELL

PRIOR APPLICATION

This application is a continuation of U.S. patent application Ser. No. 382,670 filed May 27, 1982, now abandoned which is a division of our copending, commonly assigned U.S. patent application Ser. No. 151,695 filed May 20, 1980, now U.S. Pat. No. 4,341,604, a continuation-in-part of our copending, commonly assigned U.S. patent application Ser. No. 57,255 filed July 12, 1979, now U.S. Pat. No. 4,343,689.

STATE OF THE ART

Monopolar electrolysis cells with ion permeable separators both of the percolating type or of the semi-permeable ion-exchange type generally consist of an operatively intermeshed array of hollow screen cathodes and hollow screen anodes and the ion permeable separator is applied over the cathodes, which are generally rigidly connected to the cell housing and separates the housing into at least one catholic compartment and at least one anodic compartment.

The interelectrodic gap is on the order of several millimeters which entails a high cell voltage due to ohmic drop in the electrolyte. More recently, anodes which can be expanded after cell assembly have been proposed for monopolar diaphragm cells and they have proven themselves useful in percolating asbestos diaphragm cells for grossly diminishing the interelectrodic gap. However, they cannot be used satisfactorily in cells equipped with the extremely thin, ion-permeable polymeric separators, because of the difficulty of applying an uniform and constant pressure on the membrane which can easily be ruptured by excess compression between the foraminous electrodes.

Moreover, the known expandable anodes typically based on the elastic memory of flexible metal arms or on fixed mechanical expanders, are completely inadequate for use in solid polymer electrolyte cells wherein the current collector screens must establish a good electrical contact with the electrodes bonded on the surface of the membrane. It has been found that the electrical contact resistivity and therefore, the ohmic drop in this kind of cell is a function of the applied pressure and therefore, means are needed for positively exerting the required pressure uniformly over the entire surface of the electrodes and to maintain this pressure constant during operation notwithstanding temperature fluctuations and consequent thermal expansions of the hardware.

Another aspect of known monopolar cells for brine electrolysis is that the cell housing usually holds the anolyte and therefore the housing must be internally cladded with a material chemically resistant to wet chlorine and electrochemically inert under anodic polarization because the anodes are electrically connected and extend from one of the tank sides, usually from the bottom of the tank.

OBJECTS OF THE INVENTION

It is an object of the invention to provide a novel electrolysis cell equipped with an ion-permeable membrane sheet with porous electrodes in direct contact therebetween with a minimum interelectrodic gap in which the cell is subjected to a constant and uniform resilient pressure.

It is a further object of the invention to provide an improved process for the production of halogens, especially chlorine, by electrolysis of an aqueous halide solution with a minimum amount of electrical energy.

These and other objects and advantages of the invention will become obvious from the following detailed description.

THE INVENTION

The novel method of the invention for generating halogen comprises electrolyzing an aqueous alkali metal halide in an electrolytic cell having an anode compartment and a cathode compartment separated by a sandwich, said sandwich comprising an ion permeable diaphragm having an oppositely charged electrode unit in contact with each side of the diaphragm, each said electrode unit having a porous electrode surface in direct contact with the side of the diaphragm and comprising an electroconductive porous screen engaging the surface and adapted to distribute current over said surfaces, maintaining an electrolyzing potential between said screens, applying resilient spring pressure at a plurality of spaced points of one screen while restraining the other screen to compress the electrode units and the diaphragm together, feeding alkali metal halide electrolyte to one electrode and feeding water to the other electrode. Preferably, at least one electrode is bonded to the diaphragm and the screen engaging therewith is pressed against the electrode.

The novel electrolysis cell of the invention is comprised of a housing containing a plurality of alternating anode units and cathode units and an ion-permeable membrane sheet disposed therebetween and having in contact with opposite sides of the membrane sheet a porous anode and a porous cathode, said cathode units comprising a pair of spaced foraminous cathodes forming a space for catholyte therebetween and means for flowing aqueous electrolyte through the catholyte space of the cathode unit and means for removing electrolysis products, the anode units comprising a pair of spaced foraminous anodes forming a space for anolyte therebetween, means for flowing aqueous halide solution through the said anolyte space and means for removing electrolysis products therefrom and means for uniformly compressing the units and membranes together whereby the electrodes are in firm electrical contact with the surface of the membrane.

In this type of cell, in which porous electrode layers may advantageously be bonded to the membrane and the current distributed by metal screen current distributors, the pressure holding the units together is of primary importance because the cell voltage depends to a great deal on the contact ohmic drop between the current distributor screen and the bonded electrodes. The said ohmic drop has been found to be inversely proportional to the applied pressure which has to be exact and constant on the cell to maintain the cell voltage low without rupturing the extremely thin membrane sheets.

In a preferred embodiment of the invention, the current distributors for the anode and cathode are mesh screens which are supported by a plurality of spaced ribs connected to the electrical current source and the spaced ribs of the cathode are offset from the ribs of the cooperating anode whereby the membrane, with or without porous electrode layers bonded to either side thereof, assumes a slight sinusoidal shape. This permits an optimum amount of pressure to be exerted upon the membrane without rupturing the membrane. If the ribs of the cathode and the anode were directly aligned, the membrane could be pinched between them, which would cause a non-uniformity of the interelectrodic gap at these points and could lead to rupture of the membrane.

In another embodiment of the invention, the ribs of the anode and cathode current distributor screens may be replaced with a metal sheet with offset vertexes formed by bending the sheet on which the screen is secured. The membrane is again subjected to a resilient pressure with a sinusoidal bending thereof. The membrane is an example of diaphragms useful in the cell.

The pressure to be applied to the cell may be applied externally or internally, or both. For example, the alternating anode units and cathode units may be assembled together and compressed together by outside external resilient pressure such as a hydraulic piston. In another embodiment, the current distributor screens may be pressed against the membrane by internal means. For example, the offset ribs and offset vertexes discussed above may be replaced by helicoidal springs to press the screens against the bonded electrodes. The ribs and vertexes supporting the current distributor screens need not be offset if the screens are parallel planar and very rigid so that the screen will not pinch the membrane when the pressure is applied.

The membrane of the cell is preferably a stable, hydrated, cationic film which possesses ion transport selectivity so that the cation exchange membrane permits passage of the cations and minimizes passage of the anions therethrough. Various types of ion exchange resins may be fabricated into membrane to provide selective transport of cations and two types are the so-called sulfonic acid or carboxylic acid cation exchange resins. In the sulfonic acid cation type which are the preferred type, the ion exchange groups are hydrated sulfonic acid radicals, $—SO_3H.\ nH_2O$ which are attached to the polymer substrate or backbone by sulfonation. The ion exchanging, acid radicals are not mobile with the membrane but are fixedly attached to the backbone of the polymer to ensure that their concentration within the polymeric membrane does not vary.

Perfluorocarbon sulfonic acid cation membranes are preferred because they provide excellent cation transport, they are highly stable, they are not affected by acids and strong oxidants, they have excellent thermal stability, and they are essentially non-variable with time. One specific preferred cation polymer membrane is sold by Du Pont Company under the trade name "Nafion" and is one in which the polymer is a hydrated copolymerof polytetrafluoroethylene and perfluorosulfonylethoxy vinyl ether containing pendant sulfonic acid groups. These membranes are used in the hydrogen form which is the way they are customarily obtained from the manufacturer. The ion-exchange capacity (IEC) of a given sulfonic cation exchange membrane depends upon the concentration of the $SO_3^-$ radical in the polymer, that is its equivalent weight (EW). The greater the concentration of the sulfonic acid radicals, the greater the ion-exchange capacity and hence the capability of the hydrated membrane to selectively transport cations. However, as the ion exchange capacity of the membrane increases, so does the water content and the ability of the membrane to reject anions decreases. In the case of the electrolysis of hydrochloride acid one preferred form of the ion exchange membrane is one sold by Du Pont Company under its trade designation "Nafion 120". The ion exchange membrane is prepared by hydrating it in boiling water for a period of one hour to fix the membrane water content and transport properties.

According to a preferred embodiment of the present invention, the electrodes are preferably made of powdered electrocatalytic material with very low halogen and hydrogen overvoltages and the anode is preferably comprised of at least one reduced platinum group metal oxide which is thermally stabilized by heating the reduced oxides in the presence of oxygen. Examples of useful platinum group metals are platinum, palladium, iridium, rhodium, ruthenium and osmium. However, thermal stabilization is not necessary.

The preferred reduced metal oxides for chlorine production are reduced oxides of ruthenium or iridium. The electrocatalyst may be a single, reduced platinum group metal oxide such as ruthenium oxide, iridium oxide, platinum oxide, etc. but it has been found that mixtures of reduced platinum group metal oxides are more stable. Thus, an electrode of reduced ruthenium oxide containing up to 25% of reduced oxide of iridium, and preferably 5 to 25% of iridium oxide by weight, has been found very stable. Graphite may be present in an amount up to 50% by weight, preferably 10–30% since it has excellent conductivity with low halogen overvoltage and is substantially less expensive than platinum group metals, so that a substantially less expensive yet highly effective halogen evolving electrode is possible.

One or more reduced oxides of a valve metal such as titanium, tantalum, niobium, zirconium, hafnium, vanadium or tungsten may be added to stabilize the electrode against oxygen, chlorine, and the generally harsh electrolysis conditions. Up to 50% by weight of the valve metal is useful with the preferred amount being 25–50% by weight.

The electrodes are bonded to the membrane sheet by known methods such as by mixing particles of the electrocatalytic material, graphite or electrical extender and a resin stable under the electrolysis conditions and the blended mixture may be placed in a mold and heated until the mixture is sintered into a decal form which is then bonded to and embedded into the membrane surface by application of heat and pressure.

Various other methods may be used to bond the electrode to the membrane. For example, U.S. Pat. No. 3,134,697 describes a process wherein the electrode structure is forced into the surface of a partially polymerized ion exchange membrane to integrally bond the gas absorbing particle mixture to the membrane and emded it in the surface of the membrane.

The resin used to bond the electrode to the membrane has to be inert to the electrolysis conditions existing in the cell and is preferably a fluorinated polymer. Particularly preferred are polytetrafluoroethylene resins sold under the trade name of Teflon. The amount of resin in the mixture may vary but 15 to 60% by weight of the composition, especially about 15 to 20% by weight, has been found to be satisfactory.

The cathode electrocatalytic material may similarly be a mixture of Teflon-bonded graphite with the same alloys or mixtures of reduced oxides of ruthenium, iridium and titanium or with ruthenium itself. Alternatively, other noble metals such as platinum group metals, nickel steel, silver, intermetallics such as borides, carbides, nitrides, and hydrides may be utilized. The cathode, like the anode, is bonded to and embedded in the surface of the cation membrane. The reduced ruthenium oxides lower the overvoltage of hydrogen discharge and the iridium and titanium stabilize the ruthenium. Instead of an ion-exchange membrane, a porous polymeric electrolytepermeable diaphragm may be used as well, whereby the powdered electrocatalytic material constituting the electrodes may be bonded according to the same methods as followed in the case of the ion-exchange membrane. The porous diaphragm may consist of any material resistant to the conditions met in an electrochemical cell.

The anode current distributor or collector which engages the bonded anode layer should have a higher chlorine overvoltage than the catalytic anode to reduce the probability of electrochemical reactions, such as chlorine evolution, taking place at the current collector surface. Preferred materials are valve metal screens such as tantalum or niobium screens or porous graphite sheets. The chlorine evolving reaction is much more likely to occur at the bonded electrode surface because of its lower chlorine overvoltage and because of the higher 1R drop to the collector surface.

Similarly, the cathode current distributor is made of a material which has a higher hydrogen overvoltage than the cathode and a preferred material is porous graphite sheet.

Consequently, the probability of hydrogen evolution taking place at the current collector is reduced both because of the lower overvoltage and because the current collectors to some extent screen or shield the electrodes. By maintaining the cell voltages at the lowest level at which chlorine and hydrogen are evolved at the electrodes, no gas evolution takes place at the current collectors with their higher overvoltages for gas evolution.

The electrocatalyst particles used to form the electrodes. preferably have an average particle size of 5 to 100 μm, preferably 10 to 50 μm. The thickness of the porous electrode layer bonded to the membrane is usually less than 0.15 mm, preferably between 0.1 and 0.025 mm, corresponding to approximately 0.5 to 10 mg/cm$^2$ of electrode material. The electrode must have a porous character to allow maximum contact with fresh electrolyte and removal of electrolysis products.

The electrodic reactions in the cell take place at the interface between the electrode particles and the membrane sheet whereby the ionic conduction in both the anolyte and catholyte solutions are substantially eliminated and therefore, the cell voltage drop is kept at a minimum. The electronic current is provided to the electrode material through the anodic and cathodic current distributors which are connected to the external source of electricity through their respective conducting stems extending outside the tank.

In one embodiment of an electrolysis cell of the invention, an array of a plurality of alternating box-like anodic structures and foraminous open box-like cathodic structures with a membrane therebetween provided with an anode and a cathode on opposite sides thereof are arranged in a horizontal filter press arrangement resting freely on the bottom of a tank. The array is compressed against a fixed plate by a cooperating plate subjected to pressure from a suitable means such as a spring or pneumatic piston.

The anodic structures consist of a rectangular frame, preferably of inert material, and screens made of valve metal, coated with a non passivatable material on the two major surfaces, said screens being connected to a valve metal cladded current conducting stem which passes through the frame and extends outside the tank. The ion permeable membranes are applied over the valve metal screen surfaces and sealably fixed to the frame to prevent escape of reaction products. The frame is also provided with an inlet and an outlet, respectively, for the introduction of fresh anolyte and the recovery of spent anolyte and of the anodic gas.

The cathodic structures consist of two parallel metal screens connected to a central current conducting stem extending outside the tank so that catolyte in the tank may freely circulate therethrough. The tank is provided with a cover of a resilient material such as a rubber sheet with sealable openings for the current conducting stems and for the inlet and outlet piping to the various anodic box-like structures. The catholyte liquor collects in the tank and the tank is provided with inlet means for introducing water to dilute the catholyte and with a goose-neck or telescopic outlet pipe wherefrom the catholyte liquor is recovered while maintaining the liquid level inside the tank at a height sufficient to completely cover the electrodic structures. In the upper portion of the tank, a gas outlet is provided for recovering the gas formed at the cathodes.

When the electrodes are bonded onto the opposite surfaces of the membrane, the coated valve metal screens of the box-like anodic structures and the metal screen of the cathodic structures act as current collectors respectively for the anodes and the cathodes bonded to the membrane. When the filter press horizontal array of alternate cathodic and anodic box-like structures is pressed together by the pressure or spring operated clamping means, each membrane which carries the porous strata constituting the electrodes on its opposite surfaces is adequately squeezed between the foraminous screens of the adjacent anodic and cathodic structures and a multiplicity of electrical contacts between the bonded electrodes and the screens are established.

When using a pressure operated piston, a suitable pressostat on the piston chamber effectively maintains constant the fluid pressure acting on the piston and hence the clamping pressure exerted on the filter-press array of the electrodic structures.

When using an adjustable spring assembly the spring is choosen sufficiently long so that the exerted force remains substantially constant during the full thermal execursion of the cell.

The tank has no electrical function and is not in contact with the acid anolyte and therefore, it can be of any suitable inert material or alkali resistant metal. Reinforced plastic, steel and stainless steel may be conveniently used.

The tank cover is made of a resilient material such as a rubber sheet, and the resiliency of the material accommodates the slight horizontal displacements of the current carrying stems and nozzles during the pressing of the electrodes.

In a second embodiment of the cell of the invention, the anodic structure and the cathodic structure are both formed with a box-like structure with current distributors arranged therein, preferably offset from each other, and each box-like structure is provided with an inlet for introduction of liquid electrolyte and an outlet for removal of gaseous and liquid electrolysis products. The current distributor screens are welded to the outer faces of the box-like structures and a series of cathodic and anodic structures are alternately assembled with the membrane and bonded cathodes and anodes sandwiched therebetween. The end or outer cathodic and anodic box-like structures are provided on the outside with an appropriate plate, i.e. titanium plate to seal the last structure and there are provided appropirate means for providing the electrolysis current.

The anolyte such as aqueous sodium chloride is introduced into the anodic box-like structure and dilute catholyte such as dilute sodium hydroxide is introduced into the cathodic box-like structure. The spent brine and chlorine are removed from the anodic compartment and hydrogen and more concentrated sodium hydroxide are then removed from the cathodic compartment. The flow of anolyte and catholyte may be controlled to regulate the circulation within the cell which is desirable to sweep electrolysis products away from the porous electrode surface for maximum efficiency.

Referring now to the drawings.

Figure 1:
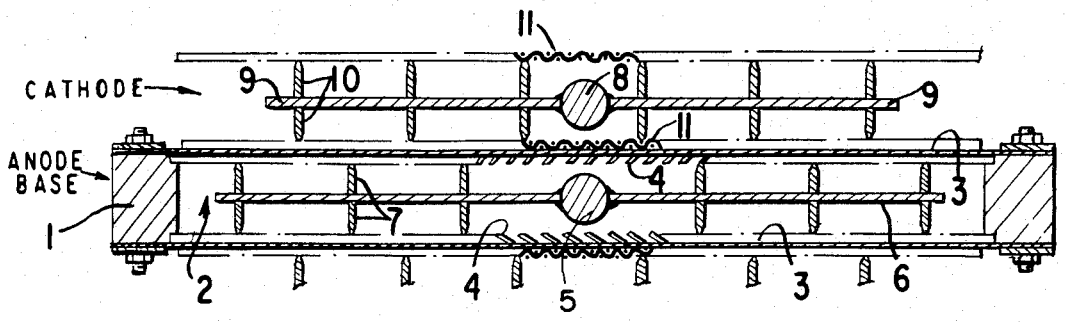
FIG. 1 is a cross-sectional view of an assembled anode and cathode structure of the invention with offset ribs and FIG. 2 is an exaggerated illustration of the bending of the membrane under the pressure exerted by the offset ribs of FIG. 1.

Referring to the drawings in more detail, FIGS. 1 to 4 illustrate the pressures to which the membrane is subjected when the cathode and anode structures are placed together in the cell. In FIG. 1, the anode structure is comprised of a valve metal frame 1 forming the anode box provided with an anolyte space 2 in which the anolyte circulates. A membrane 3 is secured to either side of box 1 and the powdered anode is firmly bonded to the inner side of the membrane. The electrical current is distributed to the powdered anode by a valve metal mesh screen, preferably provided with a non-passivatable coating such as a platinum group metal or oxides thereof. The electrical current is applied to rod 5 and passes along plate 6 and ribs 7 to screen 4. The cathode structure consists of a rod 8 to which are secured plates 9 and ribs 10 and there is attached to both sets of ribs a valve metal screen 11 which is then pressed tightly against the membrane 3 which has a powdered cathodic material bonded thereto to ensure good electrical contact between the screen 11 which acts as a current collector for the cathodic material.

Figure 2:
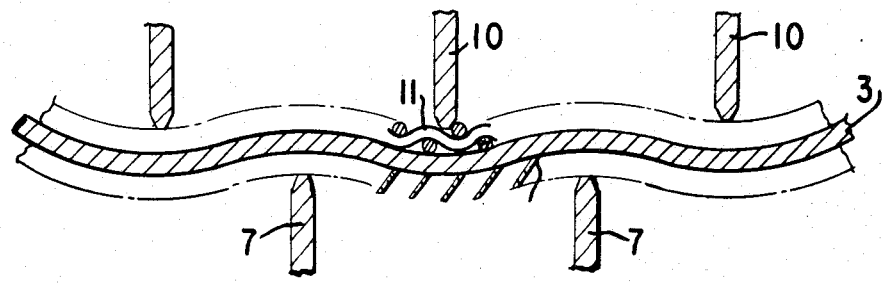

FIG. 2 illustrates schematically the bending of the membrane and anode and cathode bonded thereto due to the pressure of the offset ribs 7 and 10. The degree of bending is exaggerated to show that the current conductor or collector screens 4 and 11 have a certain degree of resiliency to slightly bend in a sinusoidal manner. The ribs 7 and 10 have to be offset from each other to avoid pinching the membrane between the ribs which would cause possible rupture of the membrane and/or deviations from uniformity in the membrane thickness.

Figure 3:
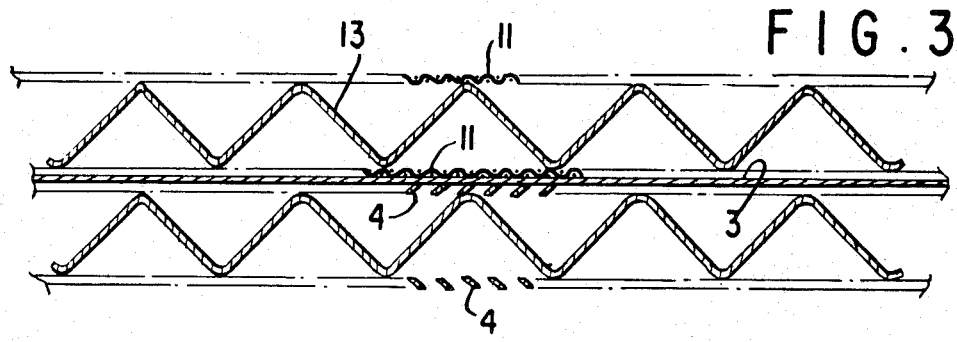
FIG. 3 is a cross-sectional view of another assembled anode and cathode structure of the invention with a bent metal sheet with offset vertexes and FIG. 4 is an exaggerated illustration of the bending of the membrane under the pressure exerted by the said vertexes.
Figure 4:
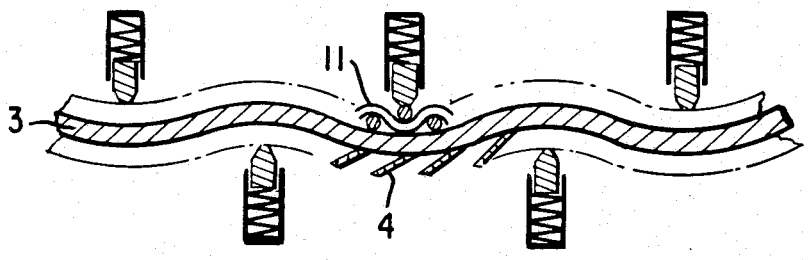

FIGS. 3 and 4 show an alternative embodiment of the invention wherein the offset ribs are replaced with a metal sheet bent to form resilient offset vertexes 13. When a resilient pressure is applied to the anode and cathode structures, there is a resilient sinusoidal bending of the metal conductor screens 4 and 11 between the pressure points of the offset vertexes 13.

Figure 5:
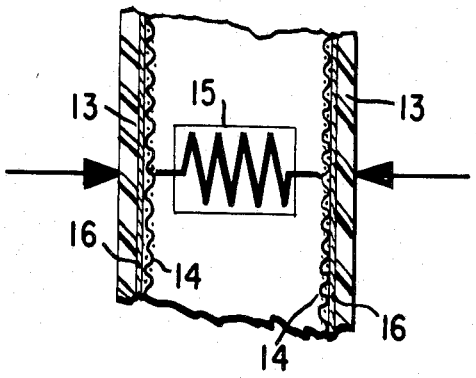
FIG. 5 is a schematic partial cross-section view of an expandable or compressible cathode structure with the presssure from a cooperating unyielding anode current conductor illustrate by arrows and FIG. 6 is a partial cross-sectional view of a specific embodiment of FIG. 5 wherein the resilient means are helicoidal springs.
Figure 6:
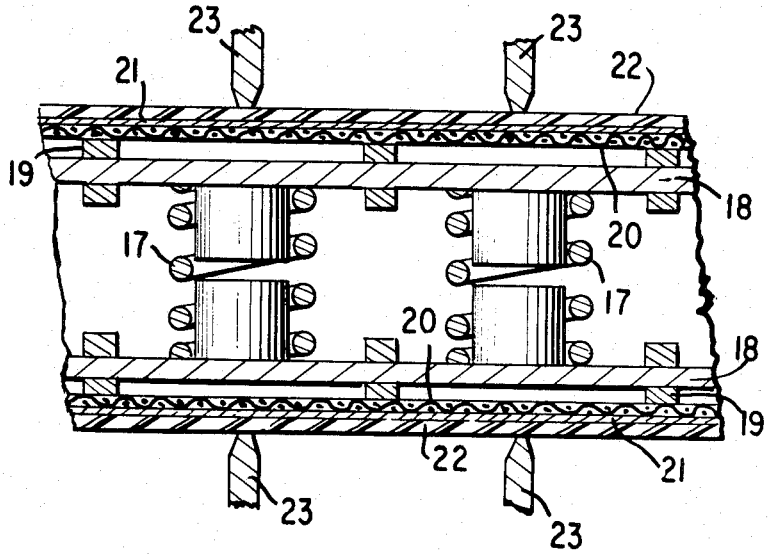

FIGS. 5 and 6 are intended to illustrate the electrical contact between the current conductor screens and the abounded electrodes whereby there is obtained an application of resilient pressure. In the schematic illustration in FIG. 5, the pressure is furnished by the expandable or compressable cathode structure which is in the interior by provision of cooperating rigid or unyielding anode current conductors 13 when spring element 15 pushes against cathode 14 to squeeze the membrane between 13 and 14 yielding constant uniform pressure. The reaction force is illustrated by the two arrows which restrain further expansion of resilient means.

In the embodiment of FIG. 6, the helicoidal spring 17 pushes against a plate 18 on which there are mounted ridges 19, which is pressed against the screen 20, which presses against the membrane 21 and anode screen distributor 22 which is supported by ribs 23 which are offset to the pressure points of the helicoidal springs and elements 19.

Figure 7:
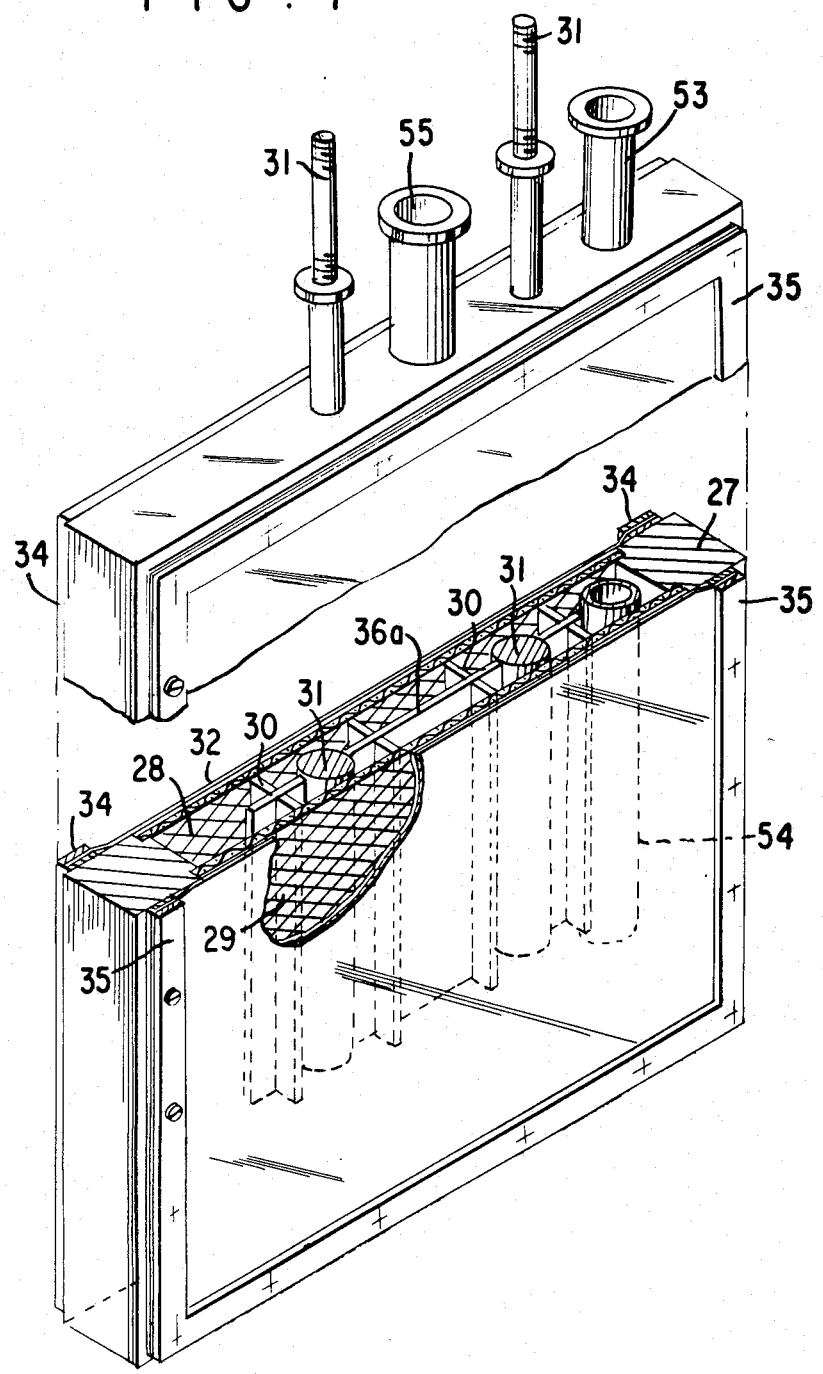
FIG. 7 is a vertical cross-section of an anode box-like structure of the invention and FIG. 8 is a perspective view of a cathode structure to cooperate with the anode of FIG. 7.

FIG. 7 shows in detail how the two anode screens 28 and 29 are welded to ribs 30. Sai ribs 30 are welded to plate 36a, made of titanium or other valve metal coated with a non-passivatable coating, which is in turn welded to rods 31. The anolyte passes into the anode box-like structure through inlet 53, which preferably extends down to the proximity of the anode structure bottom. The spent anolyte is recovered through outlet 55, together with the gas evolved at the anode.

Figure 8:
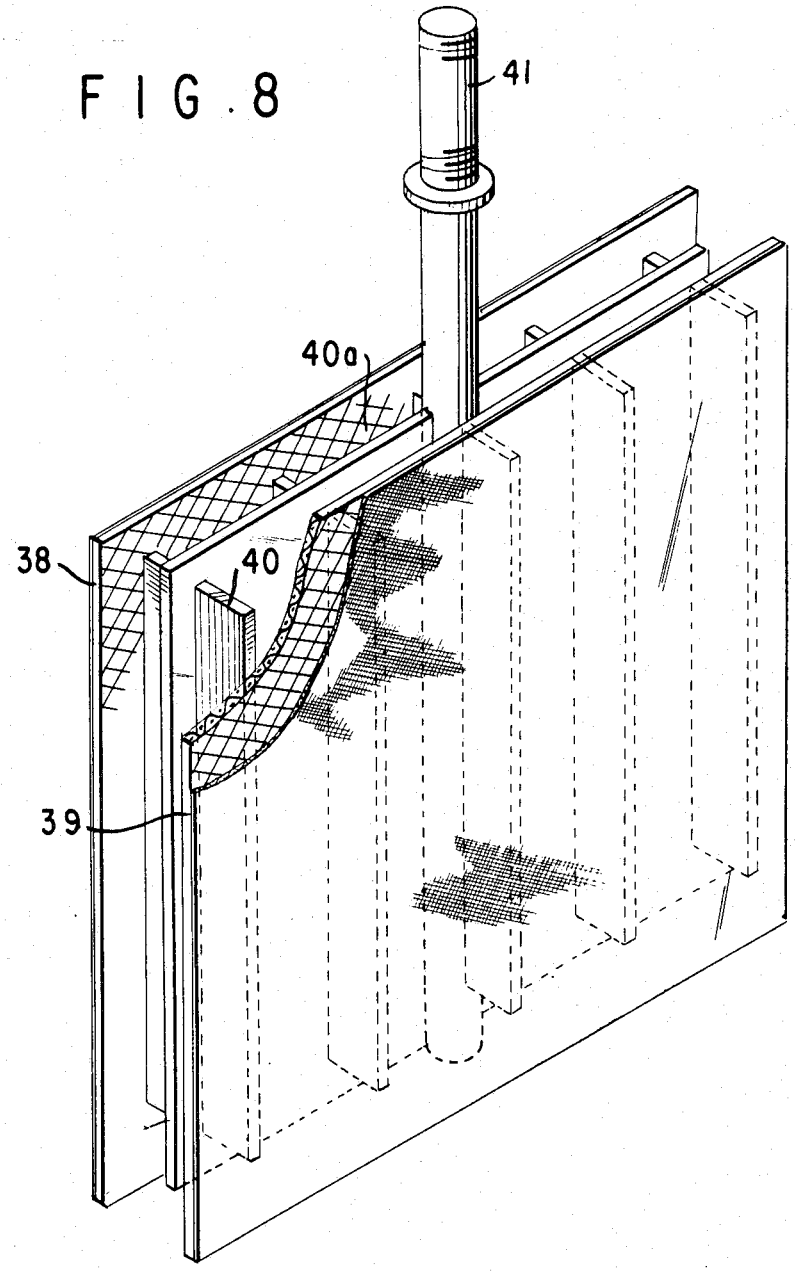

FIG. 8 is a perspective view of a cathode structure of the invention fit to cooperate with the anode box-like structure of FIG. 7. The two coarse mesh cathode current distributor screens 38, having a finer mesh cathode screen 39 applied thereon, are welded to ribs 40 which are connected to rod 41 by means of a welded plate 40 *a*.

Figure 9:
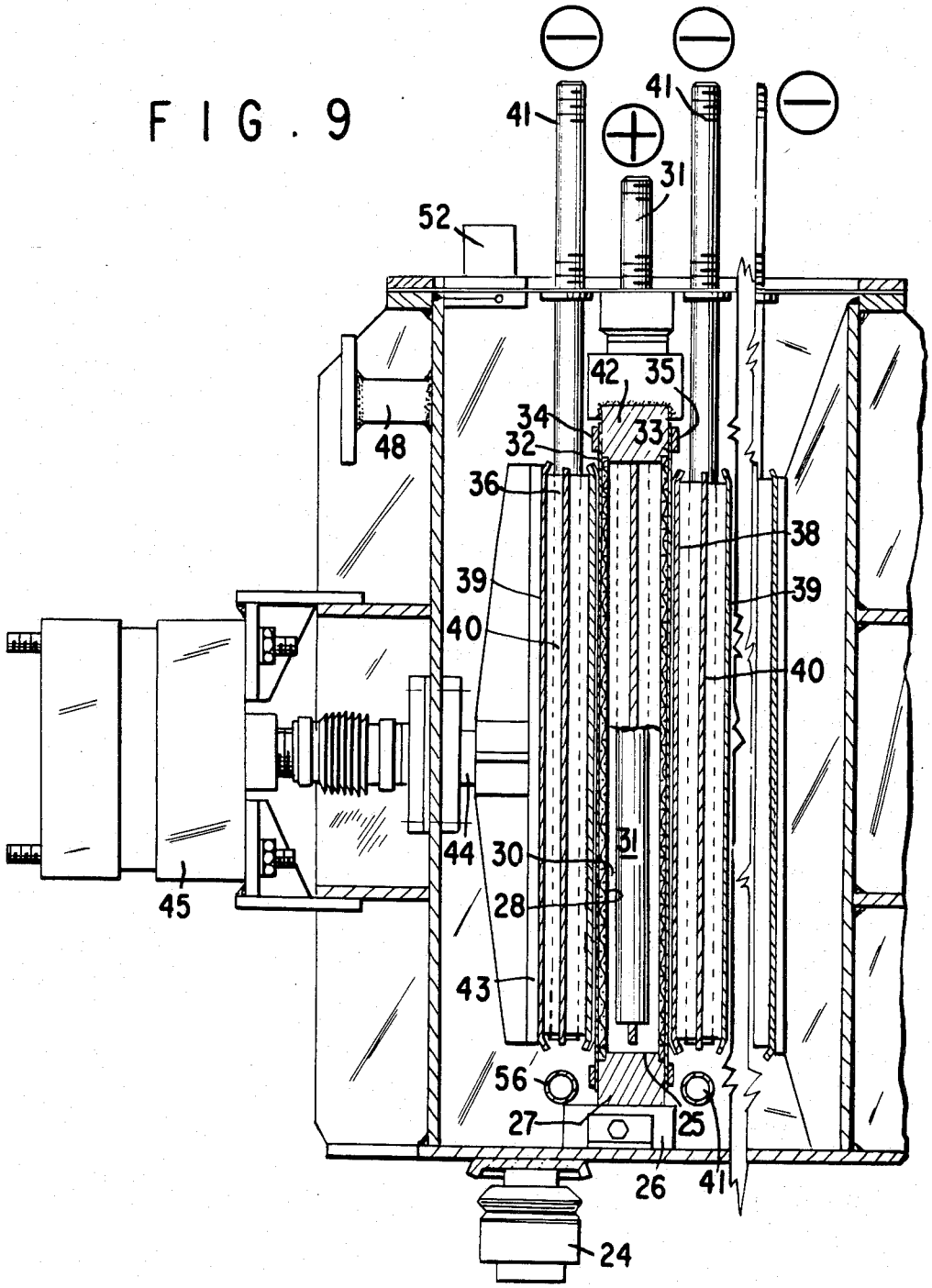
FIG. 9 is a vertical cross-sectional view of an assembled monopolar cell with the anode and cathode structures of FIGS. 7 and 8, respectively.

FIG. 9 shows how a series of alternate cathode and anode structures of the type illustrated in FIGS. 7 and 8 may be assembled to form a filter-press monopolar cell in one embodiment of the invention. As seen in a vertical section from the drawing, the cell is comprised of a box-shaped steel tank, resting on insulating supports 24. The tank may also be of stainless steel or reinforced resin, or anyway of any other material resistant to alkaline conditions.

A box-like anodic structure, indicated generically as 25, rests on a frame member 26 fixed on the bottom of the container. The anode structure comprises a reinforced resing frame 27, typically made of polyester or fiberglass. Two titanium or other valve metal screens 28, coated with a non-passivatable coating such as platinum, constitute the anodes or the anode current collectors, when respectively the anion discharge occurs thereon or when the anode whereon said discharge takes place, is made of a porous layer of non-passivatable electrocatalytic material affixed to the membrane side. The two titanium screens 28 are welded, through titanium ribs 30, to rod 31, made of copper or other highly conductive metal cladded with a sleeve of titanium or other valve metal. The rod 31, passing through the upper end of frame 27 extends outside the tank. Two ion-exchange membranes or porous diaphragms 32 and 33 are fixed on both sides of frame 27 of anode structure 25 with the aid of two gasking frames 34 and 35 and nuts and bolts both of nylon, teflon or any other inert material. Said membranes 32 and 33 separate the anode compartment defined by the box-like anode structure 25 from the cathode compartment represented by the tank. The electrodes, in the shape of porous layers of finely divided non-passivatable electrocatalytic material may be bonded onto the surfaces of the ion-exchange membranes or porous diaphragms contacting the screens 28. Two cathode structures, generally labelled as 36, are positioned adjacently to both sides of anode structure 25. Said cathode structures 36 are comprised of two expanded sheets or mesh screens of stainless steel, nickel or other suitable material welded through ribs 30 and plate 36*a* to the respective rods 41 extending outside the container. The filter-press assembly of the electrodic structures, which may comprise a whatsoever number of such alternately arranged anode and cathode structures, ends with a terminal backplate, not labeled in the Figure, of the same material as the tank and fixed to the wall thereof, whereas the other end of the filter-press assembly corresponds to a movable clamping plate 43 for instance of the same material of the tank, connected to a shaft 44, which extends outside the tank and is operated by a pneumatic piston 45. An adjustable pressostat, acting on the fluid pressure within the piston's cylinder, allows regulation and uniformity of the pressure exerted by the movable clampling plate on the filter press array.

In a different embodiment, an adjustable spring may be employed instead of the piston. In this case the spring should be chosen sufficiently long so that the exerted force remains practically constant during the thermal excursion of the cell.

The container is provided with means for introducing water or diluted solution to dilute the catholyte. Such means consist of two inlets 56, preferably with nozzles or outlet holes along their upper generatrix, positioned under and crosswise the entire cathode structures. The catholyte is discharged through outlet 48, so that the catholyte level in the container is constantly above the electrode structures therein.

The anolyte is circulated through each anode structure by means of inlet and outlet pipes, extending outside the tank and not shown in the figure.

The tank is lined with a sheet of rubber or other resilient material provided with sealable holes for the current conducting rods and the anolyte and catholyte inlets and outlets.

Figure 10:
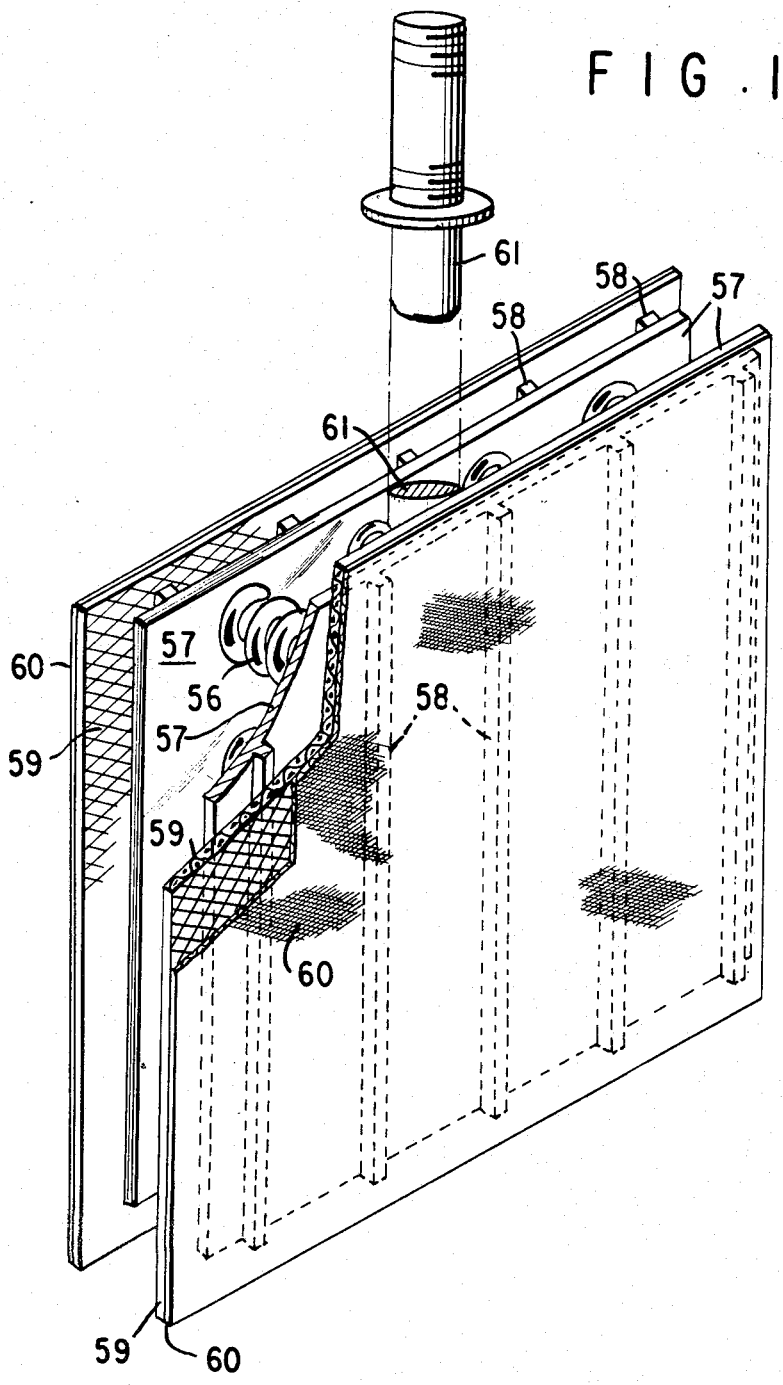
FIG. 10 is a perspective view of another cathode structure of the invention.

FIG. 10 is an alternative embodiment of a cathode structure which is open to the tank and which is comprised of helicoidal springs 56 mounted between two spring beds 57 which are made of a suitable metal such as titanium, and on the opposite side of the titanium plates 57 there are electrical contact ridges 58 on which there is mounted a coarse cathode current distributor screen 59. On the coarse screen 59 there is mounted a finer titanium screen 60 to insure more uniform contact with the cathode material bonded to the membrane surface. Current is provided to the spring beds 57 by a current connector 61.

Figure 11:
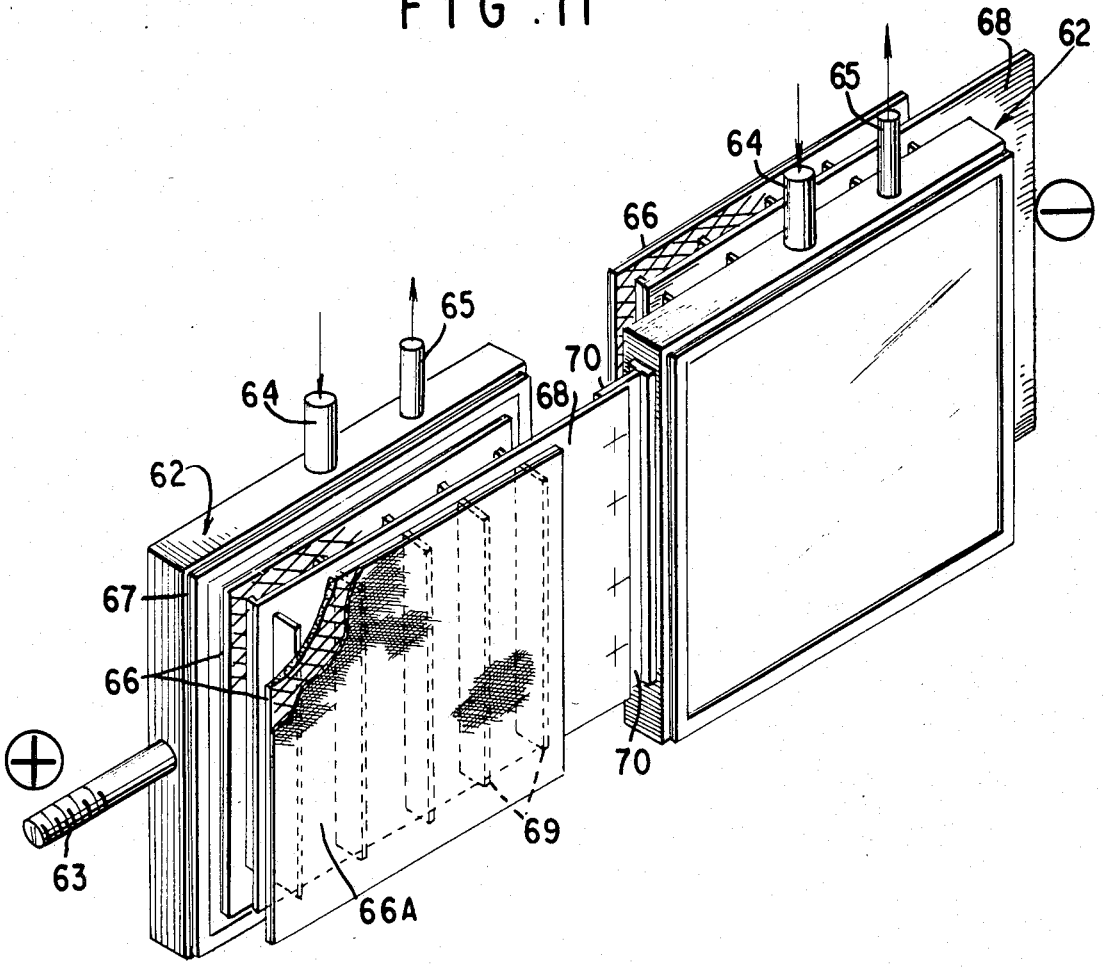
FIG. 11 is a perspective view of two monopolar cells of FIG. 9 connected to form a bipolar electrodic structure.

FIG. 11 illustrates how two or more monopolar cells similar to those in FIGS. 7 to 9 may be connected and placed in a single tank so as to form a bipolar electrodic type structure. In this embodiment, anode box like frame 62 is provided with a current lead-in 63, anolyte inlet 64, and anolyte exit 65. Cathode screens 66 are pressed in contact with membrane 67 which sits on the anode screen (not shown), and electrical contact with cathode distributor screen 66 is made by rib 69 mounted on titanium plate 68. The bipolar connection is made by connecting plate 68 with an anode connection 70 mounted on the adjacent anode box like frame 62. Again, the cathode current distributor is made up of coarse screen 66 on which there is attached a finer mesh screen 66A to insure maximum electrical contact with the various cathode. The same is effected for the anode current distributor screen.

Figure 12:
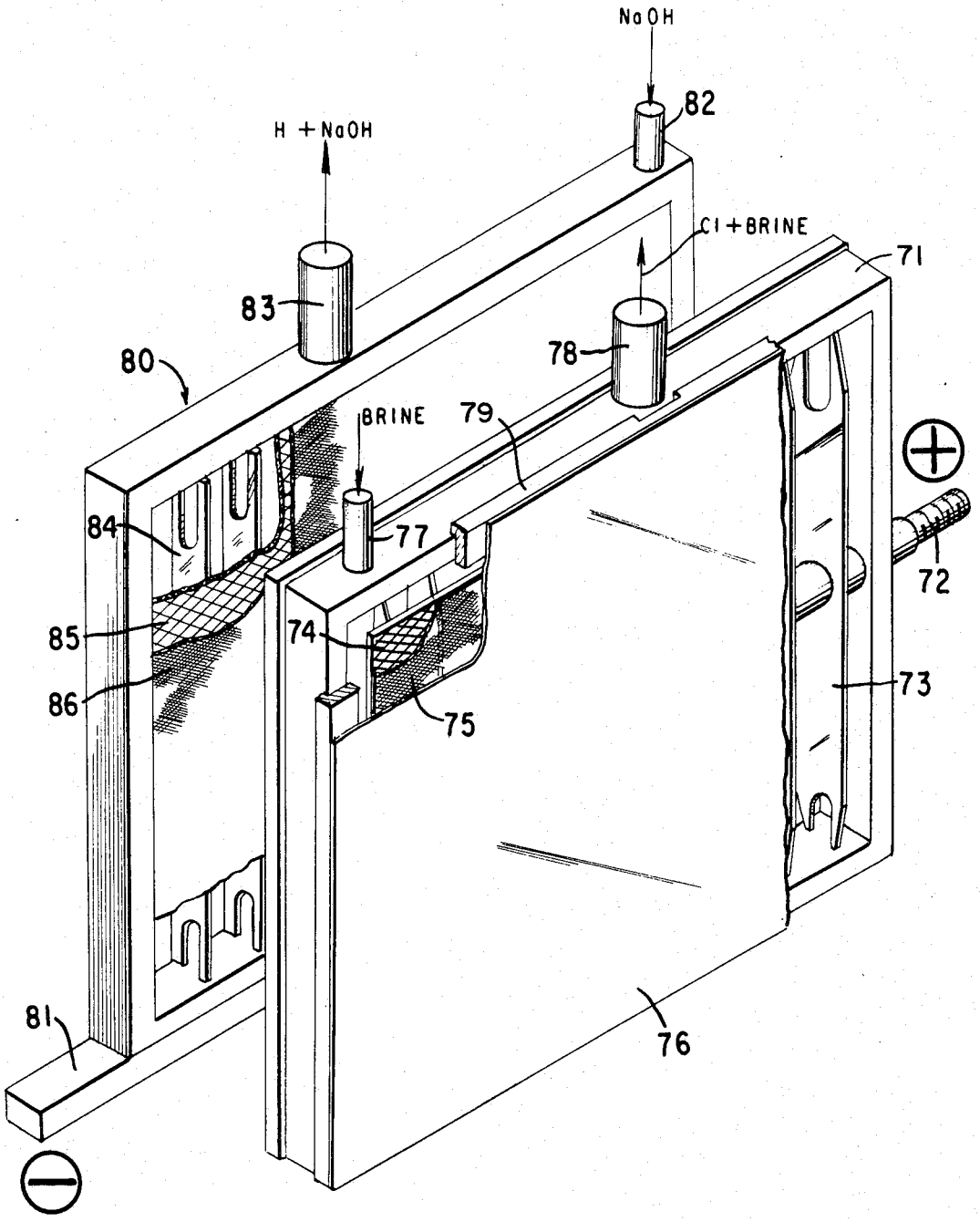
FIG. 12 is an expanded cross-sectional view of a module monopolar cell wherein a plurality of the modules may be assembled together.

FIG. 12 illustrates a modular monopolar cell in which the anode and the cathode are both surrounded by a box like structure so there is no need for an individual tank. In this type of cell, there are alternate anode box structures and cathode box like structures, and as many units can be used as desired.

In this embodiment, the anode box like structure is comprised of a frame 71 which is provided with electrical lead-in 72 and in the interior of the frame are provided a plurality of spaced ribs 73 to which is welded the coarse current distributor screen 74 on which is applied fine current distributor screen 75, on which is then placed membrane 76 on which the anode and cathode are bonded. The edges of frame 71 are provided with gasketing material 79 on which the membrane resides. The thick gasket has the necessary resiliency to compress down to the required thickness while pressing the series of box like structures together to insure a sufficient contact pressure between the opposing screens and the activated membrane therebetween.

The cathode box like structure is comprised of frame 80 which is provided with a cathode connector 81 and a catholyte inlet 82 and an outlet means 83 for removal of spent catholyte and hydrogen gas. The interior of the frame 80 is provided with a plurality of spaced ribs 84 which are offset with respect to ribs 73, and on ribs 84 there is welded cathode current distributor screen 85 which is a coarse screen on which there is connected a fine current distributor screen 86 to provide maximum contact between the distributor screen and the cathode bonded to the membrane which will be compressed between the frames 71 and 80.

Various modifications of the cell and the method of the invention may be made without departing from the spirit or scope thereof and in particular, in the case a porous diaphragm with the electrodes embedded therein is used, the cell may be run as a diaphragm cell of the percolating type, providing an anolyte head across the electrodes-diaphragm assembly to have the electrolyte flow through said assembly from the anolyte to the catholyte space.

It is however to be undersood that the invention is to be limited only as defined in the appended Claims.

We claim:

1. An electrolytic cell having a pair of oppositely charged electrodes extending along and separated by an ion exchange membrane capable of transporting cations and minimizing passage of anions therethrough, wherein one of said electrodes bearing against one side of the membrane is flexible and comprises resilient means; a restraint means supporting the other electrode is provided on the other side of the membrane, and pressure means are provided to compress said resilient means to press together at a plurality of spaced points the electrodes and the membrane substantially over the entire surface of the membrane.

2. An electrolyte cell having a pair of oppositely charged electrodes extending along and separated by an ion exchange membrane capable of transporting cations and minimizing passage of anions therethrough, wherein one of said electrodes bearing against one side of the membrane is flexible and comprises resilient means; a restraint means supporting the other electrode is provided on the other side of the membrane, and pressure means are provided to compress said resilient means to press together at a plurality of spaced points the electrodes and the membrane substantially over the entire surface of the membrane, the other electrode being less flexible than said flexible electrode.

3. The electrolytic cell of claim 1 wherein said resilient means comprises a plurality of laterally spaced compressible springs disposed along said flexible electrode.

4. The electrolytic cell of claim 2 wherein said resilient means comprises a plurality of laterally spaced compressible springs disposed along said flexible electrode.

5. The electrolytic cell of claim 2 wherein said other electrode is supported by said restraint means which is less resilient than said resilient means.

6. The electrolytic cell of claim 2 wherein said other electrode is supported by said restraint means which is substantially rigid.

7. An electrolytic cell having a pair of oppositely charged electrodes extending along and separated by an ion exchange membrane capable of transporting cations and minimizing passage of anions therethrough, wherein one of said electrodes bearing against one side of the membrane is flexible and comprises resilient means; a restraint means supporting the other electrode is provided on the other side of the membrane, and pressure means are provided to compress said resilient means to press together at a plurality of spaced points the electrodes and the membrane substantially over the entire surface of the membrane, the other electrode being substantially rigid.

8. The electrolytic cell of claim 7 wherein said other electrode is supported by said restraint means which is less resilient than said resilient means.

9. The electrolytic cell of claim 7 wherein said other electrode is supported by said restraint means which is substantially rigig.

10. An electrolytic cell having an anode and cathode extending along and separated by an ion exchange membrane capable of transporting cations and mimimizing passage of anions therethrough, wherein one of said anode or cathode is a flexible foraminous sheet, at least one anode pressure element comprising resilient means and at least one cathode pressure element comprising resilient means are provided to press said cathode, anode and membrane together at a plurality of spaced points substantially over the entire surface of the membrane, said cathode and anode resilient means being offset with respect to each other.

11. A method of generating halogen comprising electrolyzing an aqueous alkali metal halide solution in an electrolytic cell having a pair of oppositely charged electrodes extending along and separated by an ion exchange membrane capable of transporting cations and minimizing passage of anions therethrough, wherein one of said electrodes bearing against one side of the membrane is flexible and comprises resilient means; a restraint means supporting the other electrode is provided on the other side of the membrane, and pressure means are provided to compress said resilient means to press together at a plurality of spaced points the electrodes and the membrane substantially over the entire surface of the membrane.

12. A method of generating halogen comprising electrolyzing an aqueous alkali metal halide solution in an electrolytic cell having a pair of oppositely charged electrodes extending along and separated by an ion exchange membrane capable of transporting cations and minimizing passage of anions therethrough, wherein one of said electrodes bearing against one side of the membrane is flexible and comprises resilient means; a restraint means supporting the other electrode is provided on the other side of the membrane, and pressure means are provided to compress said resilient means to press together at a plurality of spaced points the electrodes and the membrane substantially over the entire surface of the membrane, the other electrode being less flexible than said flexible electrode.

13. The method of claim 11 wherein said resilient means comprises a plurality of laterally spaced compressible springs disposed along said flexible electrode.

14. The method of claim 12 wherein said resilient means comprises a plurality of laterally spaced compressible springs disposed along said flexible electrode.

15. The method of claim 12 wherein said other electrode is supported by said restraint means which is less resilient than said resilient means.

16. The method of claim 12 wherein said other electrode is supported by said restraint means which is substantially rigid.

17. A method of generating halogen comprising electrolyzing an aqueous alkali metal halide solution in an electrolytic cell having a pair of oppositely charged electrodes extending along and separated by an ion exchange membrane capable of transporting cations and minimizing passage of anions therethrough, wherein one of said electrodes bearing against one side of the membrane is flexible and comprises resilient means; a restraint means supporting the other electrode is provided on the othe side of the membrane, and pressure means are provided to compress said resilient means to press together at a plurality of spaced points the electrodes and the membrane substantially over the entire surface of the membrane, the other electrode being substantially rigid.

18. The electrolytic cell of claim 17 wherein said other electrode is supported by said restraint means which is less resilient than said resilient means.

19. The electrolytic cell of claim 17 wherein said other electrode is supported by said restraint means which is substantially rigid.

20. A method of generating halogen comprising electrolyzing an aqueous alkali metal halide solution in an electrolytic cell having an anode and cathode extending along and separated by an ion exchange membrane capable of transporting cations and minimizing passage of anions therethrough, wherein one of said anode or cathode is a flexible foraminous sheet, at least one anode pressure element comprising resilient means and at least one cathode pressure element comprising resilient means are provided to press said cathode, anode and membrane together at a plurality of spaced points substantially over the entire surface of the membrane, said cathode and anode resilient means being offset with respect to each other.

* * * * *

UNITED STATES PATENT AND TRADEMARK OFFICE

CERTIFICATE OF CORRECTION

PATENT NO. : 4,789,443

DATED : Dec. 6, 1988

INVENTOR(S) : Oronzio deNora et al

It is certified that error appears in the above-identified patent and that said Letters Patent is hereby corrected as shown below:

Title page:

| Col. | Line | Assignee |
|---|---|---|
| [73] | | "Oronzio deNora Impianti Elettrochimici S.p.A. Milan, Italy" should be --Oronzio deNora Technologies, Inc. Houston, Texas |

Signed and Sealed this

Twenty-first Day of March, 1989

*Attest:*

*Attesting Officer*

DONALD J. QUIGG

*Commissioner of Patents and Trademarks*